United States Patent [19]

Hay et al.

[11] Patent Number: 4,631,950

[45] Date of Patent: Dec. 30, 1986

[54] PROGRESSIVE FORMER WITH REMOVABLE TOOLING

[75] Inventors: Thomas E. Hay; Robert E. Wisebaker; Gaylen O. Kline, all of Tiffin, Ohio

[73] Assignee: The National Machinery Company, Tiffin, Ohio

[21] Appl. No.: 611,521

[22] Filed: May 17, 1984

[51] Int. Cl.[4] ..... B21D 45/00

[52] U.S. Cl. ..... 72/356; 72/345; 72/405; 72/427

[58] Field of Search ..... 72/356, 427, 344, 345, 72/346, 405; 10/12 T

[56] References Cited

U.S. PATENT DOCUMENTS

| | | | |
|---|---|---|---|
| 1,166,931 | 1/1916 | Pinder | 72/433 |
| 3,165,766 | 1/1965 | Wisebaker | 10/76 T |
| 3,171,144 | 3/1965 | Maistros | 10/76 |
| 3,267,500 | 8/1966 | McClellan | 10/76 |
| 3,417,599 | 12/1968 | Burns | 72/431 |
| 3,559,446 | 2/1971 | Dom et al. | 72/337 |
| 3,604,242 | 9/1971 | Allebach et al. | 72/421 |
| 4,387,502 | 6/1983 | Dom | 29/568 |

*Primary Examiner*—Leon Gilden

*Attorney, Agent, or Firm*—Pearne, Gordon, Sessions, McCoy, Granger & Tilberry

[57] ABSTRACT

A progressive forging machine is disclosed in which a tool pack is removably mounted on the machine to facilitate tool changeovers and the like. The tool pack includes tool carriers guided in bearings on the tool pack for reciprocating movement by a bolster mounted on the machine frame. Because the tools are guided by the tool pack itself, inaccuracy of bolster alignment does not adversely affect the position of the tooling. The tool pack also provides a shear, a transfer, strippers, and kickouts for both the dies and the tools. The drives for the various components on the tool pack are provided on the main machine frame and are either automatically connected during installation of the tool pack or are easily connected at the time of such installation. Because the tooling is guided by the tool pack itself, deflections within the main machine frame created by forming loads do not adversely affect tooling alignment.

18 Claims, 14 Drawing Figures

PROGRESSIVE FORMER WITH REMOVABLE TOOLING

BACKGROUND OF THE INVENTION

This invention relates generally to progressive formers for progressively forging a workpiece to a desired finished shape, and more particularly to a novel and improved progressive former in which the tools, dies, transfer and shear are combined in a tool pack which can be easily installed in or removed from the machine.

Prior Art

Progressive formers for progressively forging workpieces or blanks to a finished shape are well known. Usually, such machines provide a die breast in which the dies are mounted and a reciprocating bolster which carries cooperating tools. In such machines, the tools and the dies cooperate to provide a plurality of work stations at which a workpiece is progressively positioned by a transfer. Further, such machines usually provide kickout mechanisms for both the tools and the dies, which operate to eject the workpiece from the tools and the dies after each forming operation. Further, such machines often provide a shear which automatically cuts a workpiece from the end of bar or wire stock for subsequent forming operations of the respective work stations. Examples of such machines are illustrated in U.S. Pat. Nos. 3,171,144; 3,267,500; and 3,604,242.

Generally, such prior art machines have required considerable time and effort to change the tooling so that the machine can be changed over from one product to another. Such changeovers required the removal and replacement of the various tools and dies, and subsequent adjustment to ensure exact positioning alignment of the tools. Further, such changeovers usually required adjustment of the kickout, the shear, and the transfer. As a consequence, such prior machines have been out of production for a considerable length of time each time tooling changes were required.

In order to speed up the tool changing operations, various systems have been used. For example, in U.S. Pat. Nos. 3,559,446 and 4,387,502 (both assigned to the assignee of the present application), various systems have been described for reducing the time and effort in changing tooling.

Further, with typical prior art machines, the accuracy of the tool and die alignment has been determined by the accuracy of the positioning of the bolster. If the guide bearings of the bolster had not positioned the bolster with complete accuracy, and tools carried by the bolster were not reliably positioned with complete accuracy. This tended to result in problems, particularly when the machines were used for the manufacture of very small parts where very small amounts of misalignment can be very significant.

SUMMARY OF THE INVENTION

In accordance with the present invention, a novel and improved progressive former is provided for progressively forging workpieces at a plurality of work stations. In such progressive former, the various powered functions are provided on the basic machine frame and the tools and dies are separately mounted on a tool pack which can be easily and quickly installed or removed from the machine. In fact, in the illustrated embodiment, even the shear, stripper, and transfer are mounted on the tool pack. Therefore, in the illustrated machine all of the components which directly act on the workpiece are carried by the tool pack.

In use, the tooling is mounted on the tool pack and is adjusted at a location remote from the machine to accurately position the various components. The entire tool set-up is completed on the tool pack so that very little adjustment is required when the tool pack is installed on the machine.

The various power drive functions are arranged so that after the installation of the tool pack, such powered functions are automatically or easily connected to the tooling to permit easy completion of the final set-up of the machine for operation.

There are a number of important aspects of this invention. In accordance with one important aspect, both the tools and the dies are separately set up in a tool pack, which can be installed or removed from the machine with relative ease.

In accordance with another important aspect of this invention, the tools are guided with respect to the dies by the tool pack itself, so that the position of the tools relative to the dies is not determined by the bolster.

In accordance with still another important aspect of the invention, the basic powered functions of the machine are provided on the machine frame and are easily connected to a tool pack on which the tools and dies of the machine are mounted.

In accordance with yet another important aspect of this invention, a tool pack is provided with a shear and a transfer which is installed in the machine along with the tool pack and is removed from the machine along with the tool pack.

In accordance with another aspect of this invention, novel and improved means are provided for interconnecting the tools and the bolster in a simple but reliable manner.

In accordance with still another aspect of this invention, the kickout system for ejecting the workpiece from the dies is easily adjusted when the tool pack is installed on the basic machine.

These and other aspects of this invention are illustrated in the accompanying drawings, and are more fully described in the following specification.

DETAILED DESCRIPTION OF THE DRAWINGS

Figure 1:
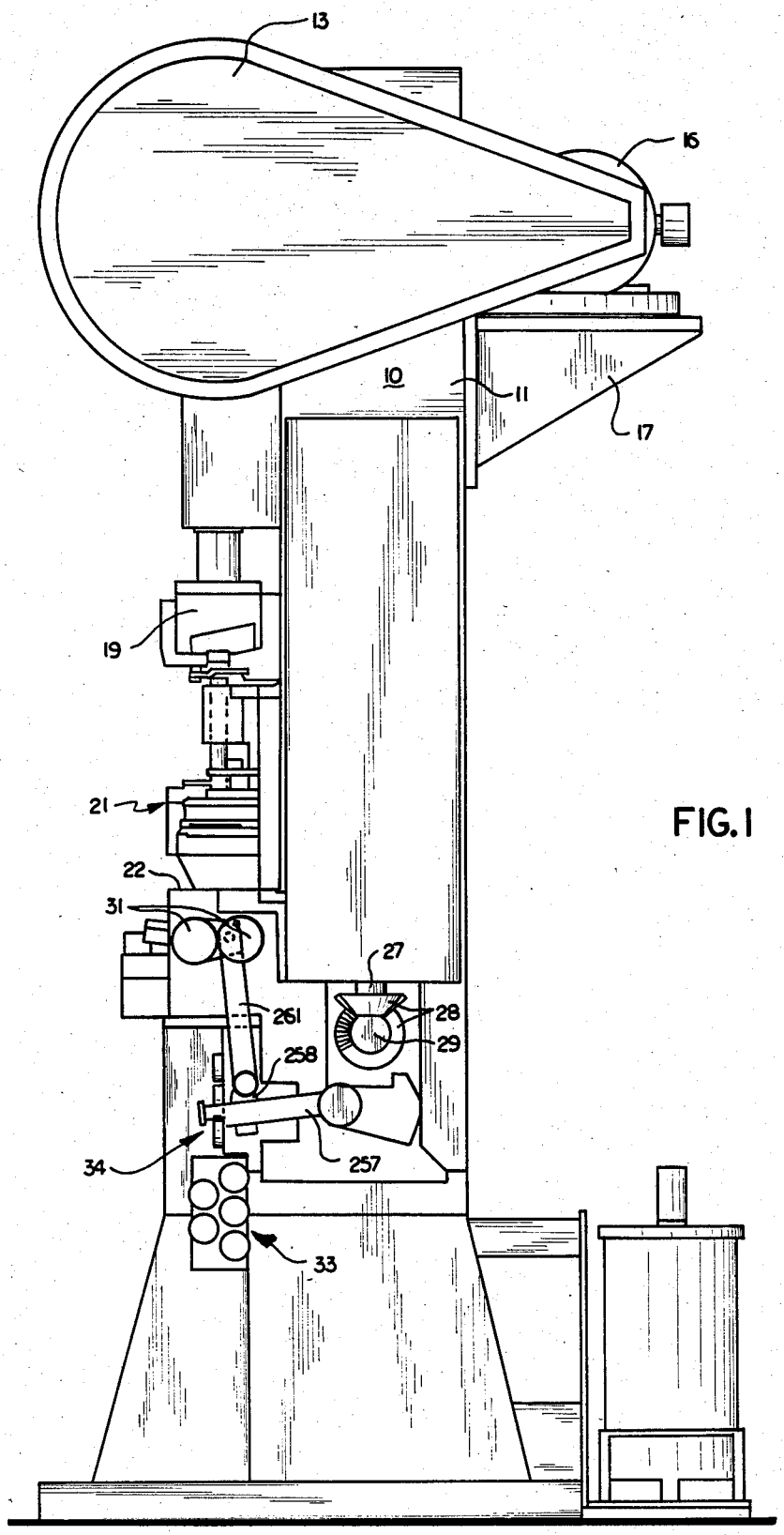
FIG. 1 is a side elevation of the overall machine in accordance with the present invention, illustrating the general arrangement of the various components thereof.
Figure 2:
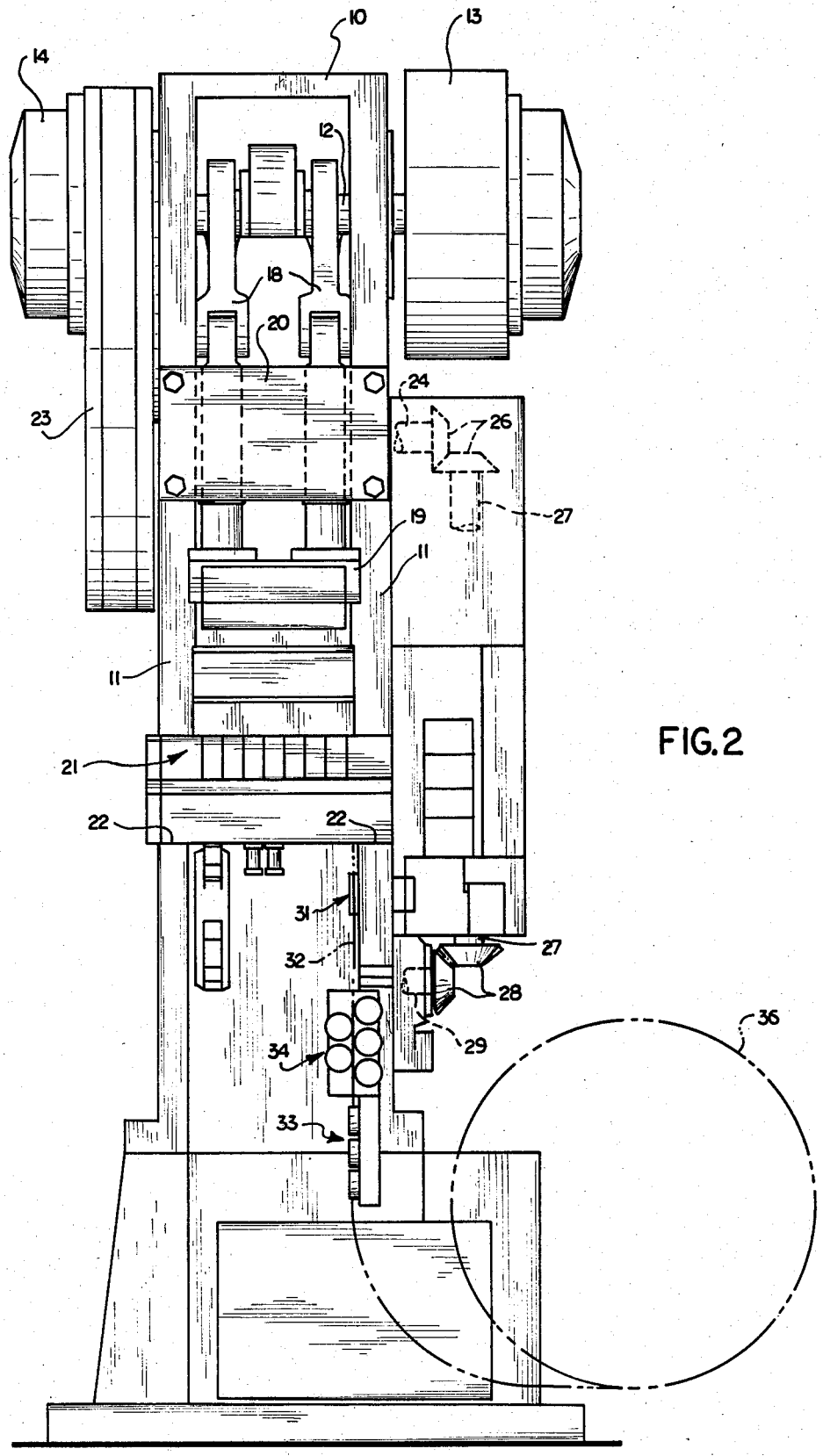
FIG. 2 is a front elevation of the machine, again illustrating the general arrangement of the components thereof.

FIGS. 1 and 2 illustrate the general arrangement of the machine. In both figures, certain elements of the machine have been either illustrated schematically or, in some instances, parts have been eliminated for purposes of illustration. The machine is provided with a basic frame structure 10 providing two vertically extending side portions 11 which are spaced from each other so as to provide a central frame opening. Journaled on the upper end of the frame 10 is a crankshaft 12 providing a clutch 13 at one end and a brake 14 at the other end. A motor 16 supported on a rearward extension 17 of the frame is connected through the clutch 13 to drive the crankshaft 12.

A pair of pitmans 18 connects the crankshaft 12 and a bolster 19 and operates to reciprocate the bolster in response to rotation of the crankshaft. The bolster 19 is guided by bearings carried by a cross member 20 on the side portions 11 for linear reciprocation.

A removable tool pack 21 is removably mounted on the frame 10, as discussed below. The forging loads on the tool pack are absorbed by laterally extending frame surfaces 22 provided by the side portions, as discussed in greater detail below.

Power for operating the various functions of the machine in timed relation to the rotation of the crankshaft 12 is provided by a gear train 25 located within a gear housing 23, which connects the crankshaft to an upper cross shaft 24. The upper cross shaft 24 is connected through bevel gearing 26 to a vertically extending shaft 27 which extends down along the side of the machine. Bevel gearing 28 located at the lower end of the side shaft connects with a lower cross shaft 29, which extends across the machine below the tool pack 21. The various gearing connecting the crankshaft to the upper cross shaft 24, the side shaft 27, and the lower cross shaft 29 is arranged so that each of the shafts rotates through one revolution when the crankshaft rotates through one revolution. Consequently, the various shafts 24, 27, and 29 rotate in timed relation to the rotation of the crankshaft, and are timed with the reciprocation of the bolster 19.

Cams mounted on the three shafts 24, 27, and 29 are connected through linkages, as discussed in detail below, to power the various component functions of the machine, including the tool kickout system, the shear, the transfer, the stripper, the die kickout system, and the stock feed.

Mounted on the frame 10 below the tool pack 21 are feed rolls 31 which engage stock illustrated in phantom line at 32 and pull it through first and second straightener assemblies 33 and 34, respectively, from a coil 36 of such stock, illustrated in FIG. 2. The feed rolls are powered by a cam-driven linkage system, discussed in detail below, and operate to move the forward end of the stock into a shear carried by the tool pack, which functions to cut work pieces from the end of the stock for subsequent working by the tools and dies carried by the tool pack 21.

Figure 3:
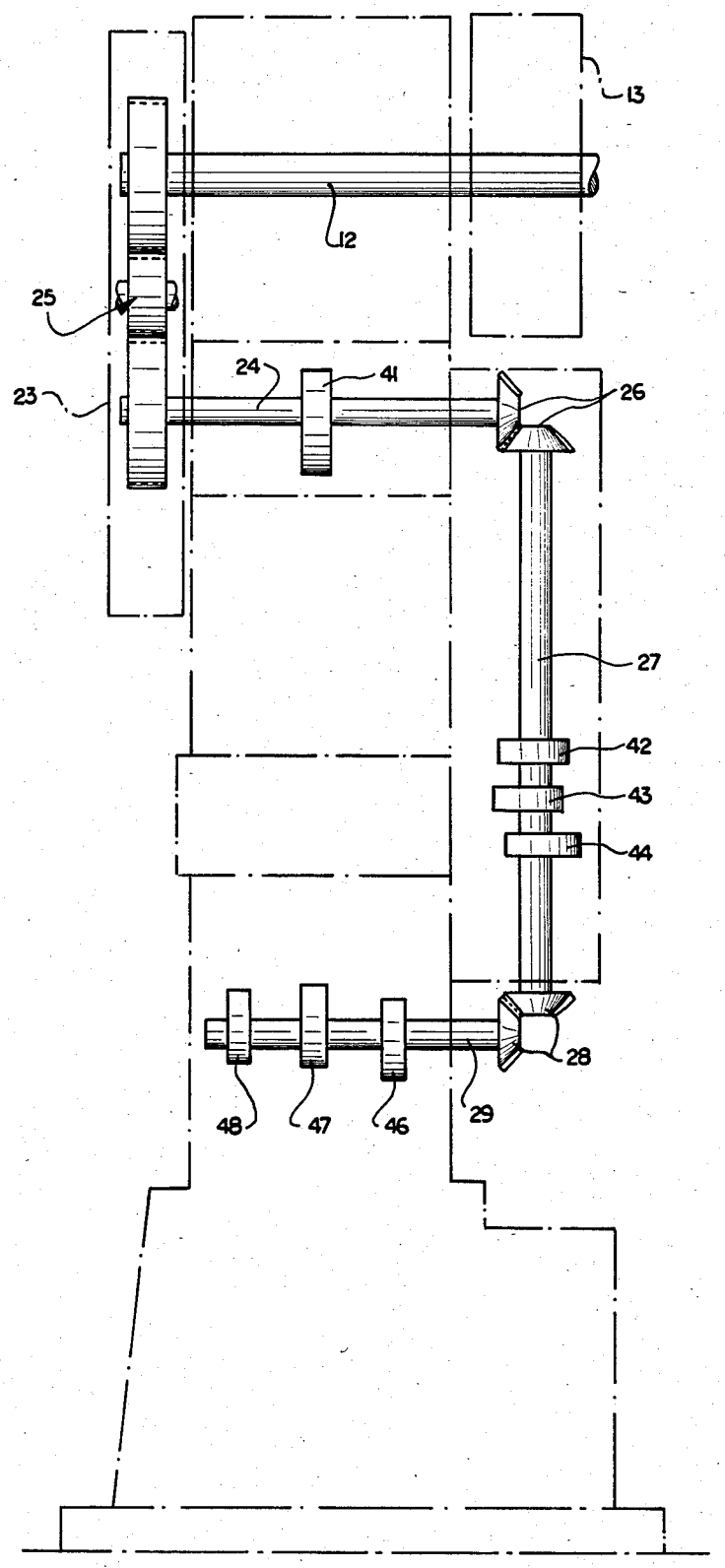
FIG. 3 is a front elevation of the basic drive train of the system, illustrating the various drive shafts and the cams mounted on such drive shafts which power the various machine functions.

Referring to FIG. 3, a cam 41 is mounted on the upper cross shaft 24 to power a linkage which operates the kickout mechanism for tools. The cams 42, 43, and 44 are mounted on the vertical shaft 27, and operate linkages which power the shear and transfer. The cam 42 powers the shear which cuts the workpieces from the stock. The cam 43 operates the linkage for reciprocating the transfer, and the cam 44 powers the linkage for opening the transfer grippers. Three cams 46, 47, and 48 are mounted on the lower cross shaft 29. The cam 46 operates the linkage which drives the feed rolls, the cam 47 operates the linkage which drives the stripper, and the cam 48 operates the linkage which operates the kickouts for the dies. Each of the linkages powered by the respective cams is described in detail below.

The Tool Pack

Figure 4:
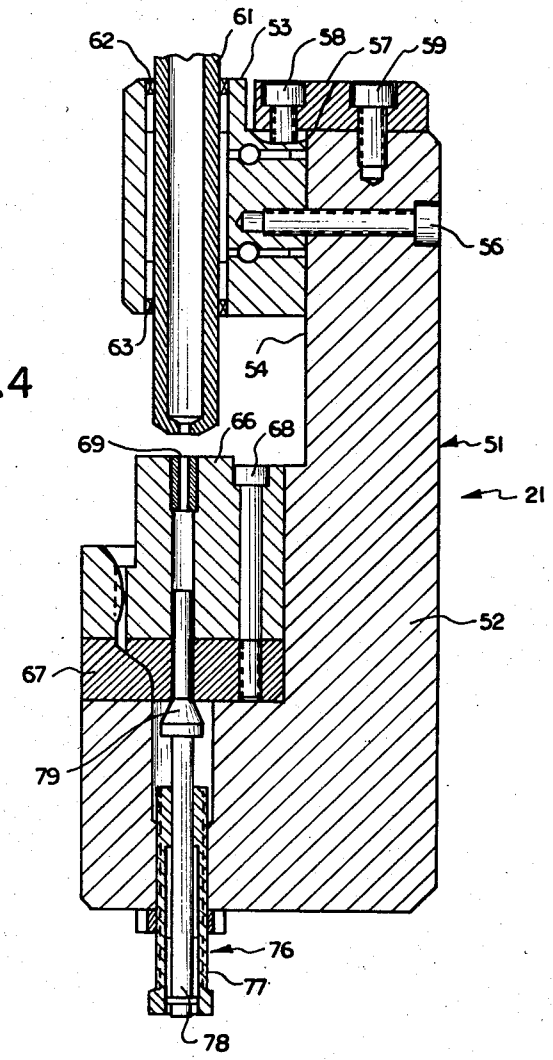
FIG. 4 is a side elevation in cross section, illustrating the tool pack which is separately removable from the basic machine.
Figure 5:
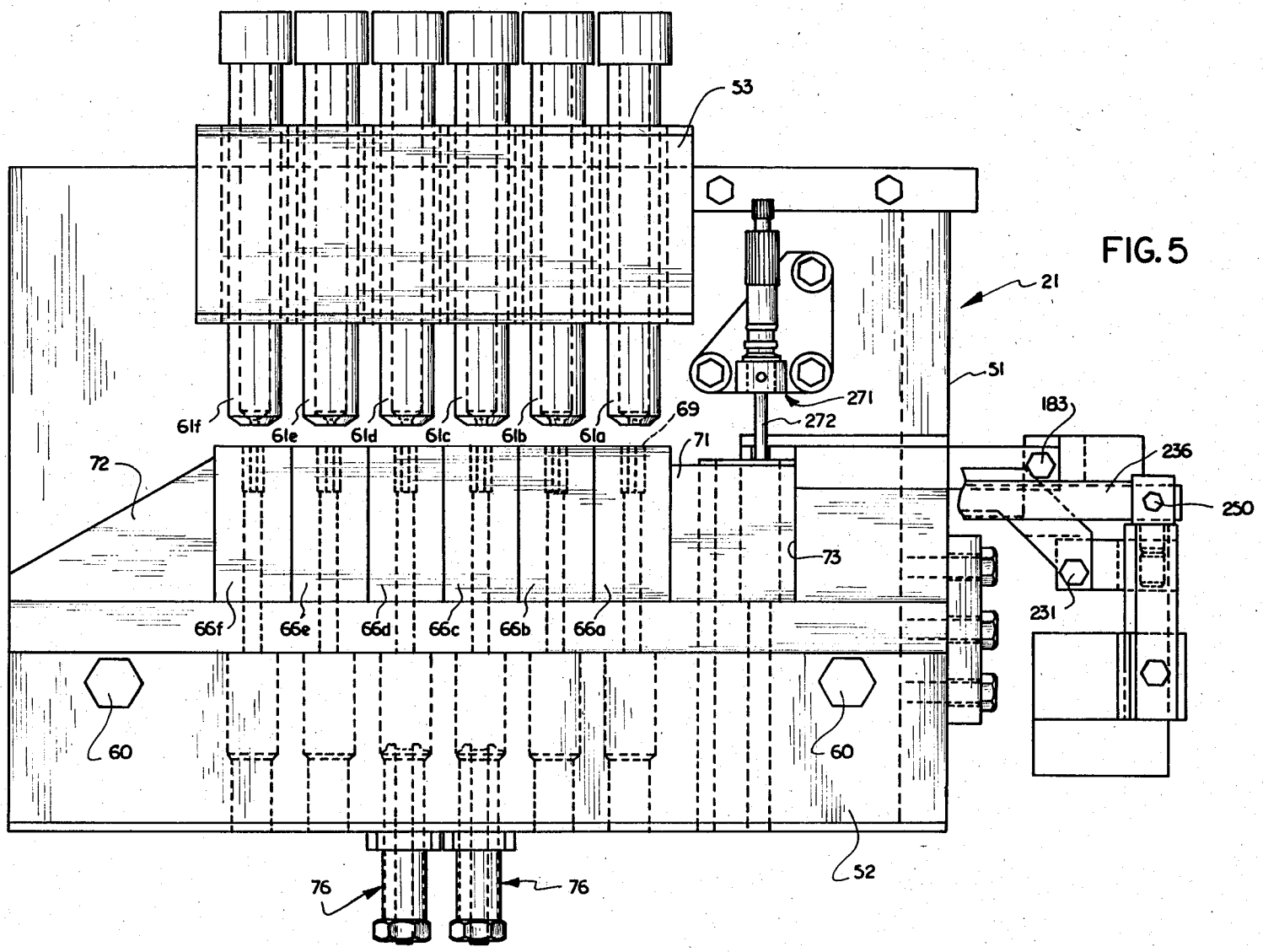
FIG. 5 is a front elevation of the tool pack, with parts removed for purposes of illustration.

FIGS. 4 and 5 best illustrate the overall arrangement of the tool pack 21. Such tool pack provides a base assembly 51 which is removably mounted on the machine frame 10, and supports the tools, dies, shear, stripper, and transfer of the machine. Such base assembly includes a base member 52 which operates to provide the principal support of the tool pack. Mounted on the base member 52 is a tool guide member 53 which is laterally secured against a mounting face 54 by bolts 56 and is vertically positioned by a cap member 57 and mounting bolts 58 and 59. The tool pack itself is releasably secured to the machine frame by two bolts 60 which project through the base member and thread into the machine frame.

A plurality of tool supports 61 are guided for longitudinal movement relative to the tool pack in spaced bearings 62 and 63 for vertical reciprocation by the bolster 19, as discussed below. Each tool support is provided with its own bearings and is separately guided by such bearings.

Referring to FIG. 5, the illustrated machine provides six separate tool supports **61*a* through 61*f*, so the illustrated machine is a six-station machine capable of progressively performing six separate forming operations on a workpiece. The bearings 62 and 63 associated with each of the tool supports 61*a* through 61*f*** precisely position each of the tool supports with respect to the tool pack base assembly and provide the guiding structure for the respective tool supports independent of the bolster itself.

Six separate die support blocks 66 are secured to a die support plate 67 by bolts 68. A die 69 is mounted in each die support block **66*a* through 66*f* and cooperates with the tools carried by the associated tool supports 61*a* through 61*f*** to provide six work stations in which a workpiece is progressively formed.

In the illustrated embodiment, the machine is sized to form very small parts, and therefore the die and die support blocks **66*a* through 66*f* are quite small. Consequently, in the illustrated embodiment, the die support blocks are individually and progressively fitted to precisely position their respective dies 69 in proper alignment with the associated tools carried by the associated tool supports 61***a* through 61*f*. Such die support blocks are clamped in position against a shear block 71 by a clamping member 72 and the entire assembly of die support blocks, along with the shear block 71, are clamped against a fixed surface 73 by the clamping member 72. It should be understood that in some machines, adjusting means may be provided to adjust the physical location of the die mounting blocks 66*a* through 66*f* to precisely position the associated dies and tools.

A die kickout assembly 76 is provided for each work station. In FIG. 5, only two such kickout assemblies are illustrated in order to simplify the drawings. However, it should be understood that normally a separate kickout assembly 76 is provided at each work station. Each assembly in FIG. 4 includes a tubular member 77 threaded into the base member 52. A rod or pin 78 projects up through the tubular member 77 and provides an enlarged portion 79. The pin 78 engages still another kickout pin (not illustrated in FIGS. 4 and 5) which extends up into the die 69 and which operates to actually eject the workpiece from the die at the completion of the working operation. The operation of the die kickout assembly 76 and its drive is discussed in detail below.

The Tool Kickout Operating System

Figure 6:
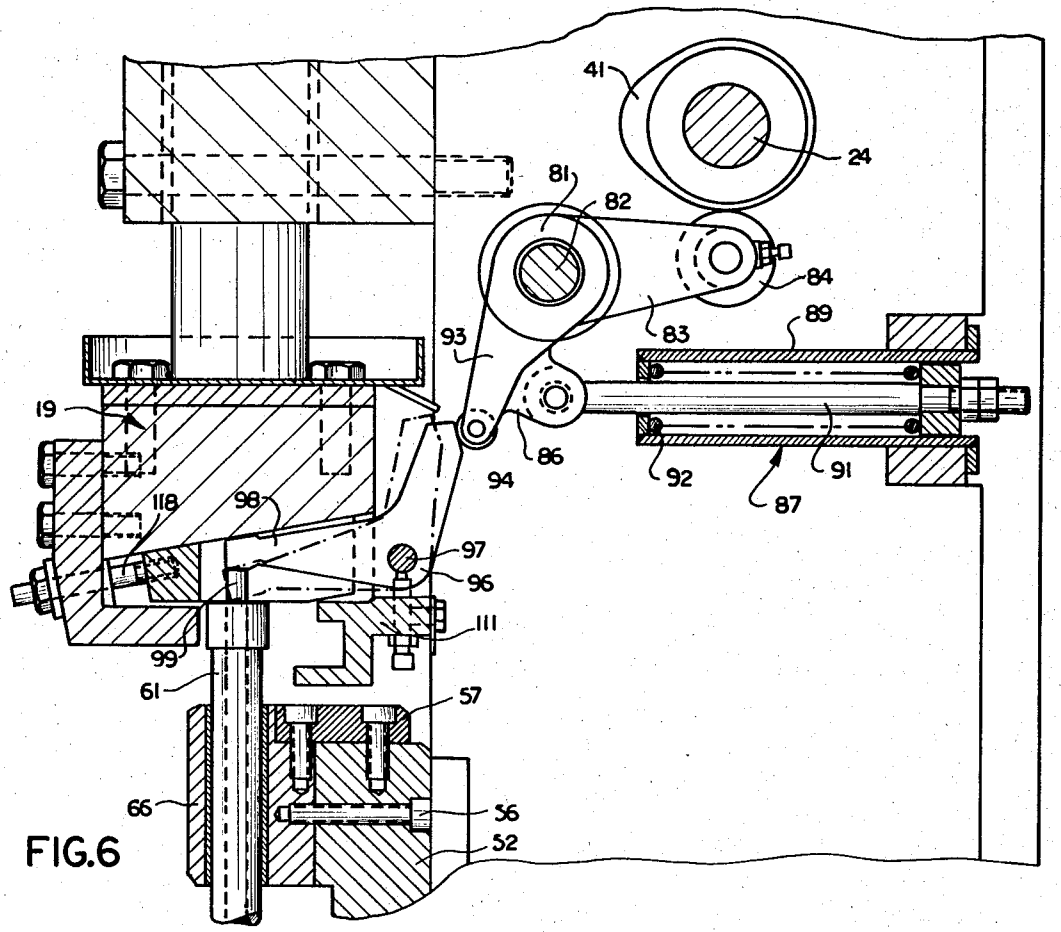
FIG. 6 is a fragmentary side elevation, illustrating the kickout drive for the tool kickout system.

FIG. 6 best illustrates the cam-driven system for operating the kickout system for the tools. Such system is powered by the cam 41 mounted on the upper cross shaft 24 and includes a lever 81 pivoted for oscillating rotation on a pivot shaft 82. Such lever 81 is provided with a rearwardly extending arm 83 which carries a cam follower roller 84 which actually engages the cam 41. As the cam 41 rotates, the engagement of the roller 84 causes the lever to rotate in a clockwise direction from the position illustrated in FIG. 6 to an operative position.

The lever is also provided with another arm 86 connected to a spring assembly 87 mounted on the frame of the machine. Such assembly includes a housing 89 and a rod 91. A spring 92 exerts a resilient force urging the rod to the right as viewed in FIG. 6 to bias the lever 81 in an anticlockwise direction to maintain the cam follower roller 84 in contact with the cam 41.

A plurality of similar arms 93 are provided by the lever 81 at spaced locations across the machine, with one arm 93 provided for each work station. In FIG. 6 only one such arm is actually illustrated, but it should be understood that additional arms of a similar structure exist and that one arm exists at each work station.

Mounted on the lower end of the arm is a roller 94 which engages a second lever 96 pivoted on the bolster 19 for oscillating rotation about a pivot shaft 97. The second lever 96 is provided with another arm 98 which projects forwardly to a position over the associated tool support 61 and engages on its underside a kickout pin 99 which is carried by the tool support 61 and projects above the upper end thereof in the full-line position. When a kickout is required for the tooling, the kickout pin is provided and extends down along the tool support to provide the actual kickout of the workpiece from the tooling. To accomplish this function, the cam causes the lever 81 to rotate clockwise from the full-line position, and in turn causes the second lever 96 to rotate in an anticlockwise direction from the full-line position to the phantom-line position of FIG. 6 to press the kickout pin 99 down with respect to the tool support 61 and to prevent the workpiece from being retracted with the tooling. In the event that a particular tool at a particular work station does not require a kickout function, a kickout pin 99 is not provided at such station and the associated lever 96 is normally removed. The machine is structured so that a lever 96 may be provided at any work station so that a kickout function can be performed at any given work station in the machine.

The System for Releasably Connecting the Tools to the Bolster

Figure 7A:
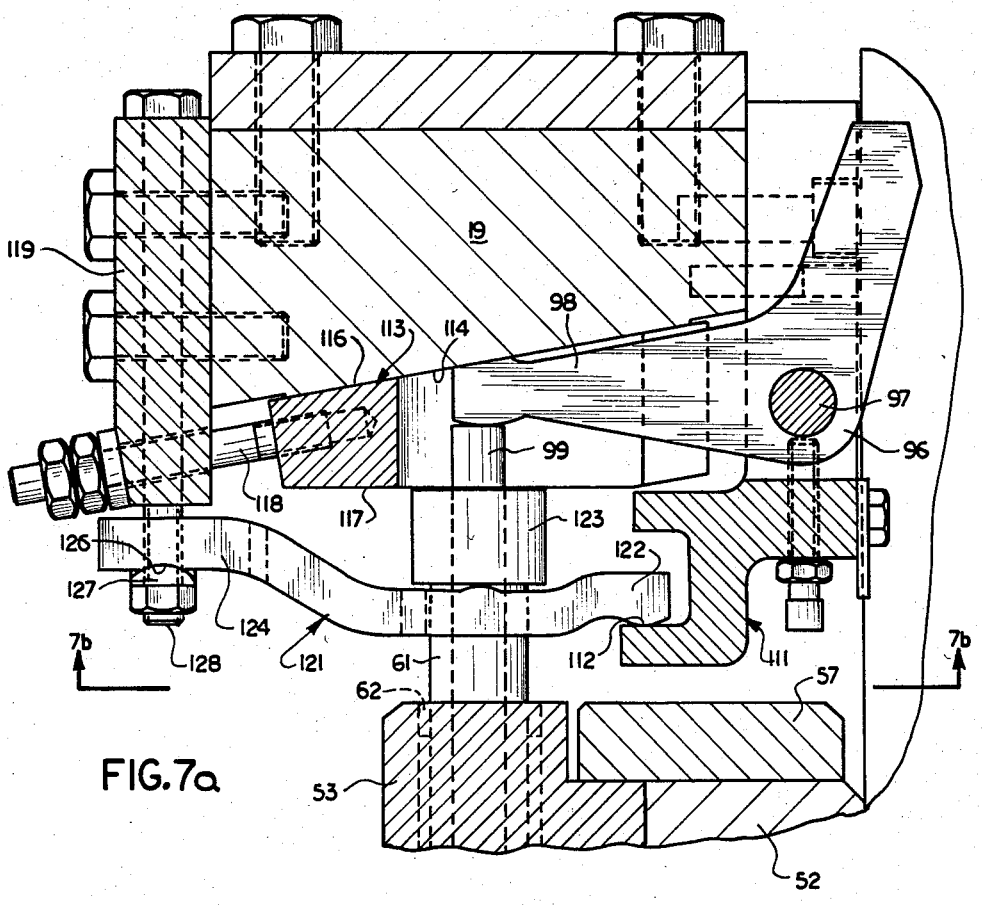
FIG. 7*a* is an enlarged, fragmentary, side elevation of the system for adjusting the tool position with respect to the bolster and of the releasable connection for releasably connecting the tools and the bolster.
Figure 7B:
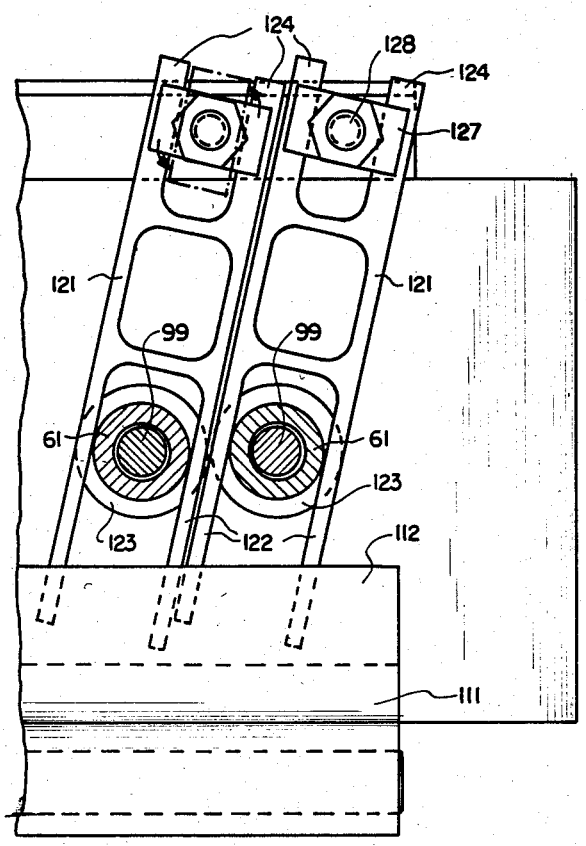
FIG. 7*b* is a fragmentary section taken generally along line 7*b*—7*b* of FIG. 7.

FIGS. 7*a* and 7*b* best illustrate the system for releasably connecting the various tools to the bolster 19 and for individually adjusting the longitudinal position of each of the tools with respect to the bolster 19. A separate connecting system is provided for each of the tool supports 61 to connect it to the bolster 19 for reciprocation therewith. Further, means are provided for separately adjusting the position of each of the tool supports 61 with respect to the bolster.

A laterally extending member 111 is mounted on the bolster 19 and provides a forwardly open shelf 112 extending past each of the work stations. Also, a separate wedge 113 is provided at each work station. The bolster 19 is provided with an inclined lower face 114 which is engaged by the upper surface 116 of the wedge. The wedge 113 provides a lower surface 117 which extends horizontally and perpendicular to the vertical movement of the bolster 19. The upper end of the tool support 61 engages the lower face 117 of the associated wedge 113. It should be noted that each of the wedges 113 is notched out to receive the forwardly extending arm 98 of the second lever 96. An adjustment screw 118 is threaded at its inner end into the wedge 113 and extends through a forward plate 119 mounted on the bolster 19. The position of each wedge with respect to the bolster is determined by the associated wedge 113, and by rotating the adjustment screw 118 associated with a given tool 61, it is possible to move the wedge forward or rearwardly with respect to the bolster and the tool support. If the wedge 113 is adjusted to the left as viewed in FIG. 7, the associated tool support 61 is adjusted downwardly with respect to the bolster. Conversely, movement of the wedge to the right results in adjusting the associated tool support 61 upwardly.

A spring beam 121 is provided to connect each of the tool supports to the bolster and to provide a releasable system for connecting each of the tool supports 61 to the bolster 19. The shape of the beam 121 is best determined by comparing FIGS. 7*a* and 7*b*. The inward end of each beam 121 is provided with two laterally spaced end extensions 122, which embrace the upper end of the associated tool support below an enlarged head portion 123 provided thereon. Such end extensions are free of the lateral connection inwardly from the tool support so that they can be moved into the installed position illustrated in which the ends of the extensions rest on the shelf 112 of the bolster. The opposite ends of the beams 121 are also provided with laterally spaced extensions 124 and are formed with shallow grooves 126 which receive a crosspiece 127 carried by a bolt 128 mounted on the bolster 19. The crosspiece 127 is formed with an upper surface illustrated in FIG. 7*a* which is curved to fit the shallow recess 126 in each of the extensions 124 in the installed position.

When it is desired to remove a given beam 121 to release the associated tool support 61, the crosspiece 127 is rotated through 90 degrees so that it extends between the two extensions 124 of the associated beam 121. The forward end of the beam is then dropped down clear of the bolt 128 and the entire beam is removed clear of the shelf 112 and the associated tool support 61. For reinstallation and reconnection of the associated tool support 61, it is merely necessary to move the beam toward its installed position until the end extensions 122 embrace the tool support and the inner ends thereof are positioned on the shelf 112. The forward end of the beam is then raised up and the crosspiece 127 is rotated 90 degrees back to the installed position illustrated.

In its installed position, each of the beams 121 is deflected from its unstressed position so as to produce a spring force urging the associated tool support 61 upwardly into tight engagement with the associated wedge. Such spring force is sufficiently strong to ensure that the tool support reciprocates back and forth with the wedge. Further, the spring action of each of the beams accommodates the adjustment of the associated wedge 113 without damage. For example, if the wedge is adjusted to the left as viewed in FIG. *7a* to lower the associated tool support 61 with respect to the bolster 19, the spring beam 121 is merely deflected a greater amount, and it is not necessary to adjust the position of the crosspiece 127 with respect to the bolt. Similarly, adjustment of the wedge to the right as viewed in FIG. *7a* to raise the associated tool support 61 merely results in less deflection of the associated beam 121, but the beam still provides sufficient force to maintain the connection required. Because the upper surface of the crosspiece is curved, it can be cammed into position without readjusting the position of the crosspiece on the associated bolt 127 each time a tool pack is installed or removed. With this system, an easily installed connection is provided which can accommodate adjustment of individual tools by properly positioning the associated wedge 113.

The Die Kickout Linkage

Figure 8:
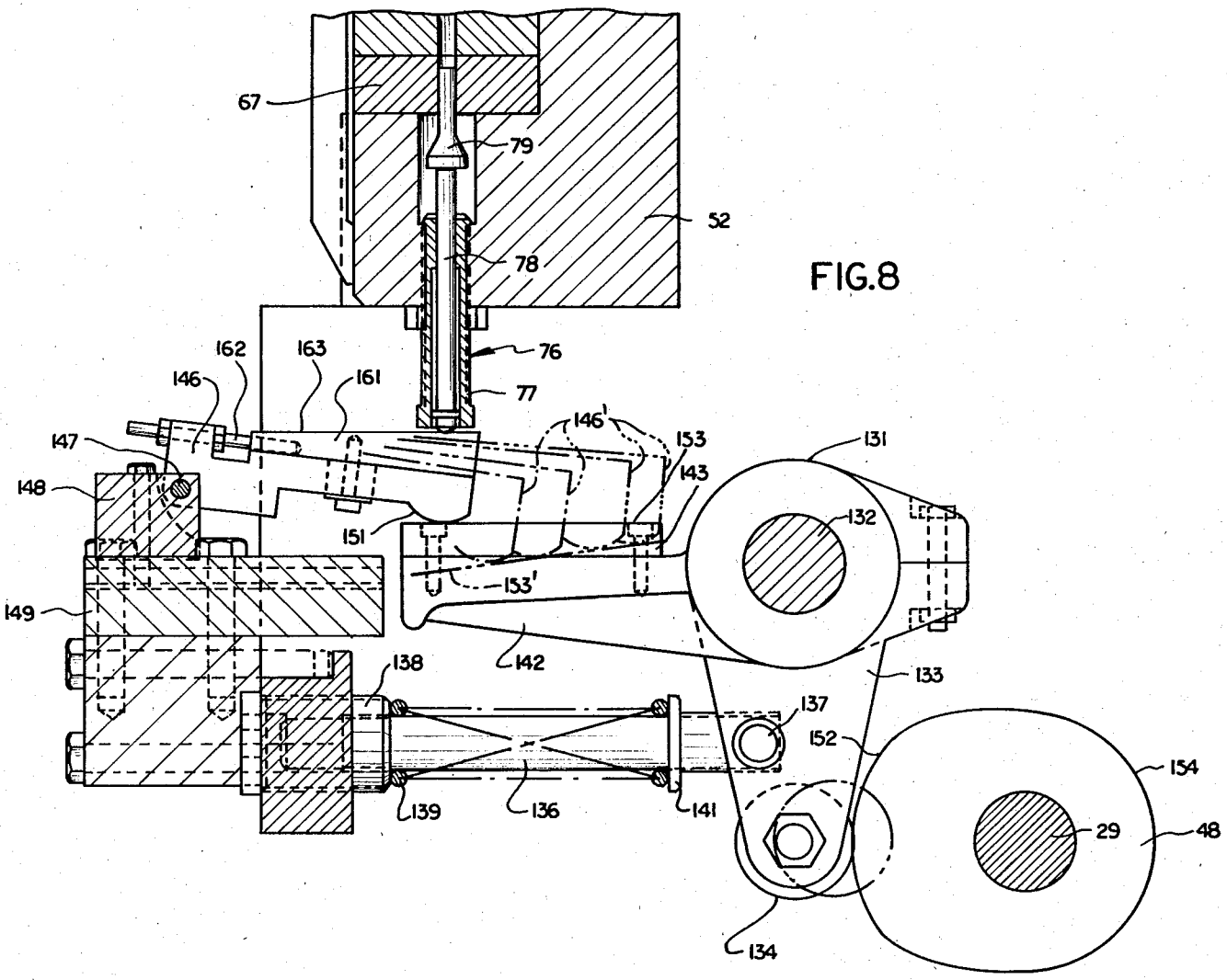
FIG. 8 is a fragmentary, enlarged section illustrating the drive for the system for ejecting workpieces from the dies.

FIG. 8 illustrates the linkage for operating and adjusting the kickout which ejects workpieces from the dies at the completion of the working operation therein. Such linkage includes the cam 48 mounted on the lower cross shaft 29, which operates to power the linkage. A rocker lever 131 is journaled on a pivot shaft 132 for oscillating rotation and provides a first lever arm 133 which extends downwardly and supports a cam follower 134 at its lower end. Such cam follower is maintained in engagement with the cam 48 by a spring system including a rod 136 pivoted at 137 on the arm 133, and extending at its forward end into the guide bushing 138. A spring 139 extends between the guide bushing 138 and a collar 141. The spring therefore provides a resilient force which biases the rocker lever 131 in an anticlockwise direction to maintain the cam follower 134 in engagement with the cam 48.

The rocker lever is also provided with a forwardly extending arm 142 which extends horizontally to a position under the work stations. Mounted on the arm 142 is a wear plate 143. A single arm 142 and a single wear plate 143 are provided which extend laterally of the machine past all of the work stations so as to provide a wear plate surface in vertical alignment with each die station. Alternatively, if desired, a separate arm 142 and wear plate 143 can be provided on the rocker arm for each work station.

An adjusting member 146 is provided for each work station and is journaled on a pivot 147 carried by an adjustable block 148 mounted in guides on a support plate 149. Such block is adjustable in a horizontal direction perpendicular to the vertical axis of the machine. The adjusting member 146 which overlies the wear plate 143 provides a curved projection 151 which engages the surface of the wear plate 143.

The cam 48 is shaped so that when the follower 134 engages an upper dwell portion 152, the surface 153 of the wear plate 143, which is engaged by the projection 151, is perpendicular to the vertical axis of the machine. Consequently, if the adjusting member 146 is moved inwardly or outwardly with respect to the frame by adjusting the block 148, the position of the adjusting member does not change. On the other hand, when the cam 48 rotates to position a lower dwell portion 154 in engagement with the cam follower 134, the surface 153 of the wear plate 143 is inclined downwardly, as illustrated by the dotted line 153'. In such instance, the position of the adjusting member 146 is a function of the adjusted position of such member, as illustrated by the phantom-line illustrations 146'. Consequently, the operative position of a given adjusting member is not affected by the adjustment of the position of such member, but the retracted or lowered position is determined by such adjustment.

Mounted on the upper surface of the adjusting member 146 is a wedge 161 which provides fine adjustment of the linkage. Such wedge is adjusted inwardly and outwardly by a threaded screw 162 and is shaped to provide an upper surface 163 which is perpendicular to the vertical axis of the machine when the linkage is in the full-line or raised position illustrated. Adjustment of the wedge 161 to the left raises the surface 163 in the raised position and adjustment of the wedge to the right lowers such surface. A lower end of the kickout pin 78 engages the surface 163 and is moved vertically up and down by the cam 48 as the machine operates.

With this linkage, the lower position of the pin is determined by the adjustment of the adjusting member, and the upward position is determined by the adjustment of the wedge 161. Considered in another way, the adjustment of the adjusting member 146 changes the stroke of the pin 78 and adjustment of the wedge 161 provides fine adjustment of the final or operative position of the pin 78.

The Shear Drive Linkage

The shear is driven by a linkage best illustrated in FIG. *9a*. Such linkage includes rocker arm 171 pivoted at 170 and providing a first arm 172 which carries a cam follower 173. The cam follower 173 engages the shear drive cam 42 mounted on the vertically extending shaft 27. Here again, a spring system is provided to maintain the follower 173 in engagement with the cam. Such spring system includes a rod 174 connected to the rocker arm 171 by a pivot 176. A spring 177 extends between an abutment 178 and a collar 179 on the rod 174 to bias the rocker arm in an anticlockwise direction.

The rocker arm is also provided with an arm 181 which connects to the shear slide 182 through a releasable connection at 183. The slide 182 of the shear is guided for reciprocating movement within a guide block 184 and carries a cutter quill 186 at its forward end. The connection includes a connector block 187 connected to a cross pin 188 on the arm 181 so that when the rocker arm 171 rotates from the full-line position in a clockwise direction, the bolster 182 is moved to the left, as viewed in FIG. 9*a*. The connection between the pin 188 and the connector block 187 is such that the arcuate movement of the arm 181 is accommodated without requiring arcuate movement of the slide. Consequently, the slide moves with straight-line reciprocation even though the pin 188 moves with an arcuate-type movement. A bolt 189 provides the means for releasably connecting the slide from the block 187.

The shear operates to move back and forth from a first position illustrated in which the shear quill is aligned with the stock feeding up through the machine through the feed rolls and a delivery position at 191. During each cycle of operation, the shear retracts to allow stock to be fed into the shear and then shears off a workpiece which is delivered to the delivery position 191 for subsequent transfer to the various work stations of the machine. Because the shear slide 182 can be easily disconnected from the drive linkage which powers the shear, the shear slide itself remains on the tool pack when the tool pack is removed from the machine.

The Transfer System

Figure 9A:
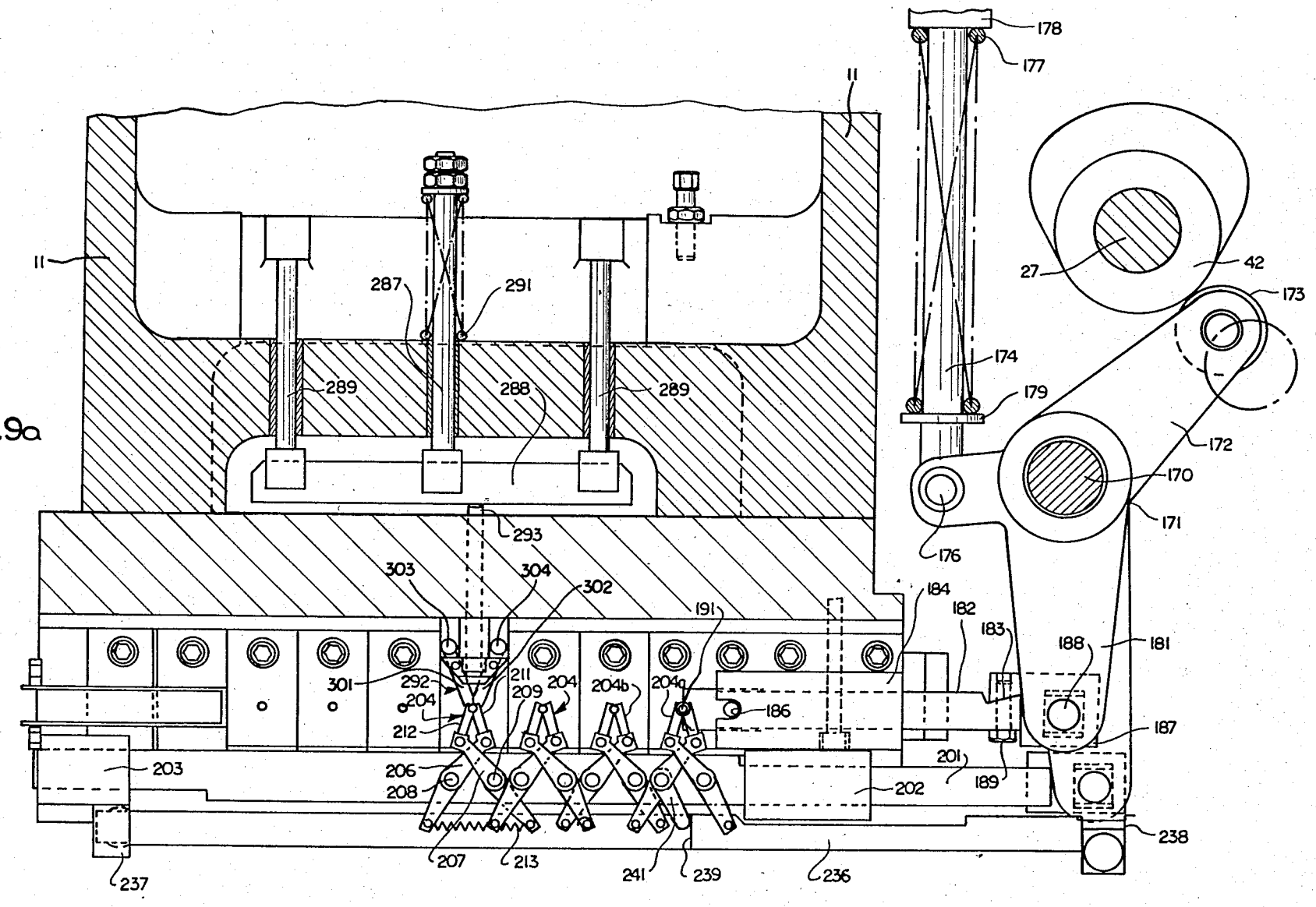
FIG. 9*a* is a fragmentary plan view of the die face, illustrating the drive for the shear and transfer system carried by the tool pack.
Figure 9C:
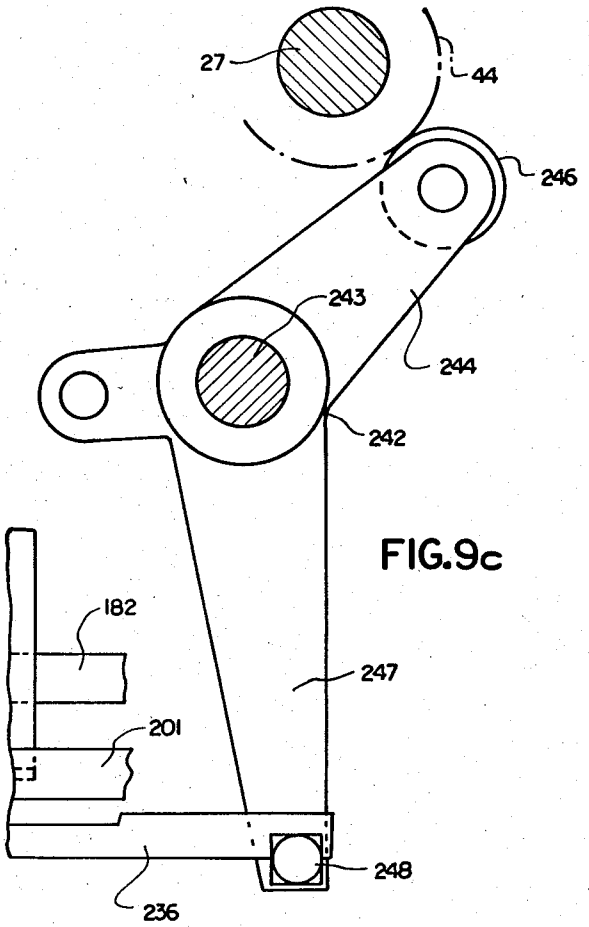
FIG. 9*c* is a fragmentary view of the linkage which opens and closes the transfer grippers.
Figure 9B:
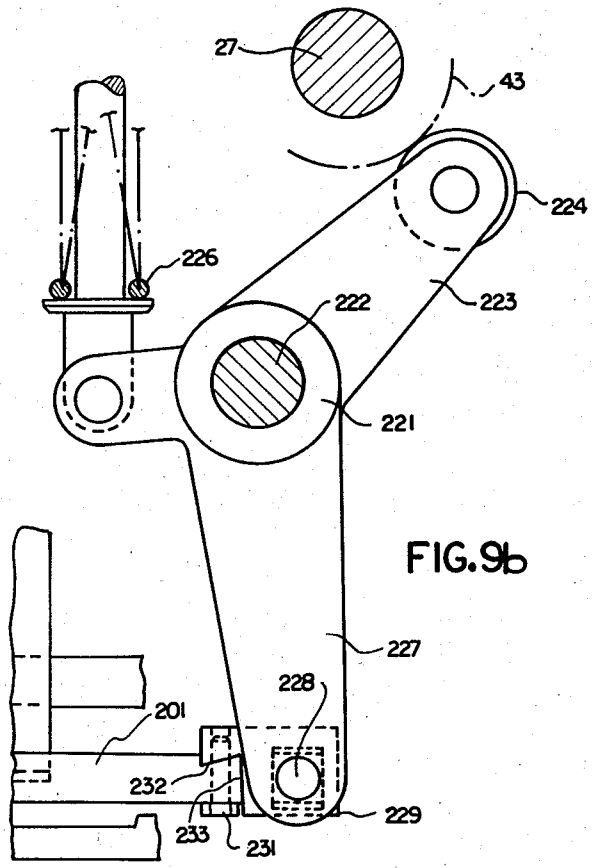
FIG. 9*b* is a fragmentary view of the transfer drive linkage.

The transfer system and its drive are best illustrated in FIGS. 9*a* and 9*b*. The transfer system includes a transfer slide 201 which extends across the forward face of the tool pack and is guided for reciprocation in bearing blocks 202 and 203. Mounted on the transfer slide are a plurality of gripper finger assemblies 204, with one assembly provided for each work station. In FIG. 9*a*, only four such assemblies are illustrated for purposes of simplification. However, it should be understood that an additional three gripper finger assemblies will normally be provided.

Each assembly includes a first lever 206 and a second lever 207, which are respectively pivoted at 208 and 209 on the slide 201. Such levers support at their inner ends gripper fingers 211 and 212, which actually grip the workpiece as it is ejected from the associated work station and support the workpiece as it is transferred to the subsequent work station. Springs 213 bias the fingers to the gripping position, but allow the gripper to move apart.

The two gripper levers 206 and 207 of each gripper assembly 204 are interconnected so that they open and close in unison by pivoting in opposite directions through equal angles. Such interconnection, however, is not illustrated to simplify the drawings, but is understood by those skilled in the art. In operation, the gripper assembly 204*a* receives the workpieces from the shear and transfers such workpiece to the first die station where it is subsequently formed. The second gripper assembly 204*b* receives the workpiece finished at the first die station and transports it to the next die station, etc., so that a workpiece is progressively worked at each work station and is transferred between work stations in a progressive manner by the subsequent gripper assembly 204. The last set of grippers moves the part to the discharge chute.

The reciprocating movement of the transfer bolster 201, and in turn the reciprocating movement of the individual transfer assemblies 204, is provided by linkage illustrated in FIG. 9*b*. Such linkage includes a rocker arm 221 pivoted on a pivot shaft 222 and providing a first arm 223. Journaled on the outer end of the arm 223 is a cam follower 224 which engages the transfer cam 43 carried by the vertical shaft 27. Here again, a spring 226 biases the rocker arm 221 in an anticlockwise direction to maintain engagement between the cam follower 224 and its associated cam 43.

The rocker arm is also provided with a forwardly extending arm 227 which carries a cross pin 228 connecting the arm to a connector block 229. Here again, a releasable connection is provided by a bolt 231 and the block 229 for releasably connecting the bolster 201 and the block 229.

It should be noted that the block 229 and the slide 201 are provided with an inclined surface 232 so that when the bolt 131 is tightened, the end of the slide is held in tight engagement with the surface 233 of the block 229. Further, it should be noted that the connection between the cross pin 228 and the block 229 is arranged to accommodate arcuate movement of the cross pin 228 without requiring a similar movement of the block 229. Here again, the transfer slide 201 is easily disconnected from its drive system so that it may be removed with the tool pack when the tool pack is removed from the machine, and can be easily reconnected when reinstalled in the machine.

Transfer Gripper Release System

A powered system for releasing or opening the grippers is provided and is best illustrated in FIGS. 9*a* and 9*c*. Such system includes a slide 236 which also extends across the front of the tool pack. Such slide is provided with a guide 237 at its left end as viewed in FIG. 9*a*, and is connected to a lever 238 at its right end. The slide 236 provides a plurality of axially spaced operating surfaces 239, with one surface 239 associated with each gripper assembly 204. Here again, for purposes of simplification of the drawings, only a single surface 239 is illustrated, but it should be understood that a surface 239 is associated with each of the gripper assemblies 204.

Each of the grippers 204 is provided with an arm 241 mounted on its lever 206 and extending to a position in alignment with the surface 239. Such lever 241 is adjustable with respect to the arm to provide a limited amount of adjustment of the timing of the gripper opening operation. When the slide 236 is moved to the left relative to the slide 201 (as viewed in FIG. 9*a*), the surfaces 239 engage the associated arms 241 and cause clockwise rotation of the associated lever 206 for releasing the grippers. Such rotation of the lever 206 through the connection (not illustrated) causes anticlockwise rotation of the associated lever 207. If a particular gripper assembly 204 is required to open earlier than another gripper, the associated arm 241 is adjusted to provide the required early timing.

Referring to FIG. 9*c*, the drive linkage for reciprocating the slide 236 includes a rocker arm 242 journaled on a pivot 243. Such rocker arm provides a first arm 244 which supports a cam follower 246 at its outer end. Such cam follower is positioned to engage the cam 44 carried by the vertical shaft 27. Here again, a spring system (not illustrated) having a structure similar to the system for biasing the rocker arm 171 is provided to maintain the cam follower 246 in engagement with the cam 44.

The rocker arm 242 is also provided with a laterally extending arm 247, which is provided with a releasable connection 248 for releasably connecting the rocker arm to slide 236. In this instance, a direct connection is provided so that the connected end of the slide 236 moves with a slight arcuate movement when the rocker arm pivots back and forth. Such arcuate movement does not present a problem, however, since the surfaces 239 can accommodate such movement and not materially affect the opening timing of the transfer fingers. Here again, the system is arranged so that the slide 236 can be disconnected from the rocker arm 242 by removal of a bolt 250 (illustrated in FIG. 5) and removed from the machine at the same time the tool pack is removed.

The Feed Roller Drive Linkage

Figure 10:
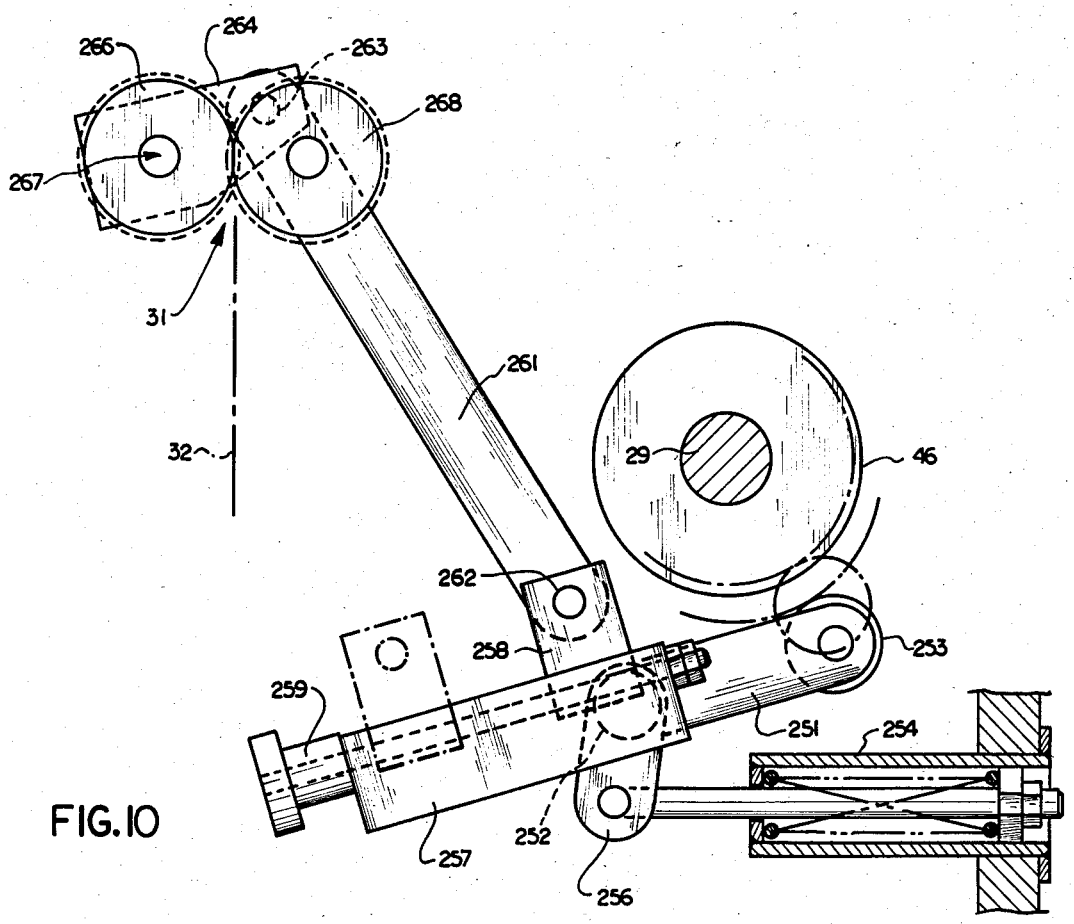
FIG. 10 is a fragmentary view of the feed roll drive linkage.

FIG. 10 schematically illustrates the linkage for driving the feed rollers of the machine. Such linkage is also partially illustrated in FIG. 1. The feed roller drive linkage includes the cam 46 mounted on the roller cross shaft 29 within the central zone of the lower. Mounted on the machine is also a follower arm 251 which is carried by a pivot shaft 252. On the outer end of the arm 251 is a cam follower 253. In the case of the pivot shaft 252, the shaft itself is pivoted and the follower arm 251 is secured to the shaft so that the shaft itself oscillates when the arm oscillates. A spring system 254 connects to an arm 256 and, in turn, applies a biasing force to maintain the cam follower 253 in engagement with the cam 46.

The shaft 252 extends out through the side of the machine and is provided at its outer end with an adjustment arm 257, which is again mounted on the shaft so that it oscillates with the shaft. Mounted on the arm 257 is an adjustment block 258, which is adjustable along the length of the arm 257 by a screw drive 259 between a full-line position illustrated and a phantom-line position. Adjustment of the block 258 with respect to the arm changes the length of the arc through which the block moves for a given angular movement of the arm 257.

A link 261 is pivoted at 262 to the adjustment block 258 and at a pivot 263 to an arm 264 connected to one of the feed rolls 266 of the feed rolls 31 through a one-way clutch. Consequently, as the cam 46 rotates and causes oscillation of the shaft 252, the arm 264 also moves with an oscillating rotation about the pivot 267 of the feed roll 266. The arm 264 is connected to the feed roll 266 through a one-way clutch so that the operation of the feed roll drive linkage causes intermittent rotation of the roll 266 in an anticlockwise direction to provide a stepped feed of the stock. The second roll 268 is connected to the roll 266 by gearing so that it also rotates with stepwise movement but rotates in the opposite direction. Consequently, stock gripped between the feed rolls is moved up into the shear in a timed relationship to the operation of the machine. The amount of stock fed into the shear during each cycle of operation is determined by the adjustment of the block 258 with respect to the arm 257.

When the feed rolls operate, they feed stock up into engagement with the stock feed stop 271 illustrated in FIG. 5. Such feed stop includes a micrometer-type adjustment system which can be adjusted to accurately position the end of a stop shaft 272 with respect to the machine so as to accurately determine the length of a workpiece being fed into the machine. Preferably, the feed stop 272 is electrically isolated from the remainder of the machine and is connected through a control circuit so that engagement of the end of the stock with the feed stop 272 creates an electrical circuit to establish a signal that a full proper length of stock has been fed into the shear. Such signal may be used to disengage the clutch and engage the brake to stop the machine in the event that improper stock feeding has occurred.

The Stripper Drive System

Figure 11:
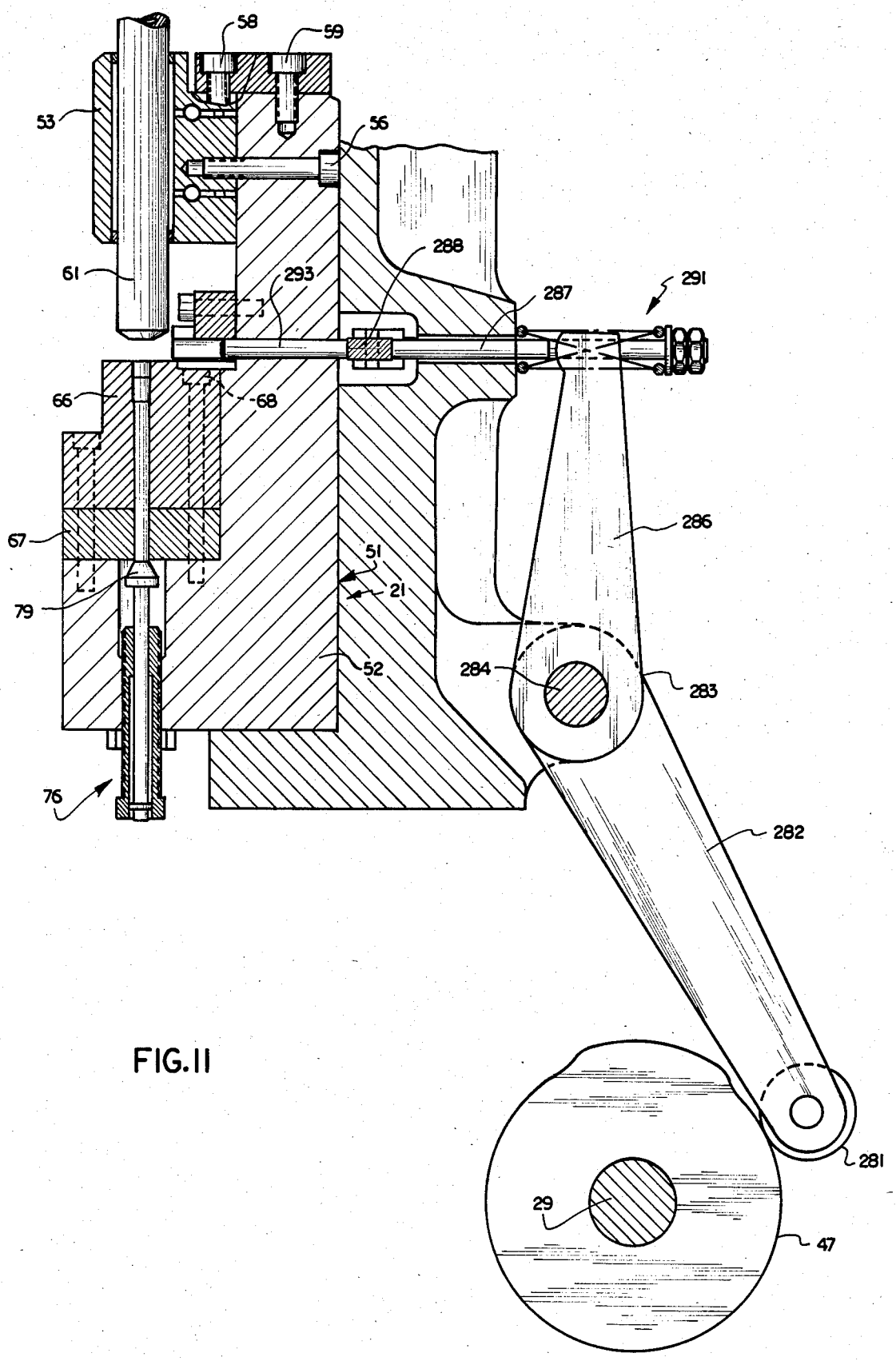
FIG. 11 is a fragmentary view of the drive for the stripper system.

FIGS. 9*a* and 11 illustrate a stripper drive system which is used when the tooling of the machine is such that a workpiece tends to remain on the tooling as the bolster retracts. Such a stripper functions to engage the workpiece and prevent its movement with the retracting tooling when required. Therefore, a stripper is not always provided at each location, but a system is provided to allow the installation of the stripper at each work station or at any one work station where its operation is required.

Referring to FIG. 11, the cam 47 mounted on the lower cross shaft 29 is engaged by a cam follower 281 journaled on the outer end of an arm 282 of a rocker arm 283. Such rocker arm is journaled for oscillating movement about a pivot shaft 284. A second arm 286 on the rocker arm 284 extends up into alignment with a pusher rod 287. Referring to FIG. 9*a*, a stripper actuator bar 288 is supported for reciprocating movement by a pair of guide rods 289 and is proportioned to extend laterally across the machine into alignment with each of the work stations. A spring system 291 biases the bar 288 rearwardly of the machine toward the arm 286 illustrated in FIG. 11. When the cam 27 causes anticlockwise rotation of the rocker arm 283, the arm 286 overcomes the action of the spring system 291 to move the bar forwardly of the machine.

Referring again to FIG. 9*a*, a stripper assembly 292 includes a pair of spring-biased arms which operate to engage a workpiece carried by the tooling and prevent movement of the workpiece with the tooling as retraction occurs. Such stripper assembly 292 is provided with a pair of arms 301 and 302 which are respectively mounted for pivotal movement about pivots 303 and 304 to open and close. The pin 293 is connected to the arms 301 and 302 to cause them to open and close in response to longitudinal movement of such pin. The cam operates to move the bar 288 back and forth and, through the rod 293, controls the operation of the arms 301 and 302. As mentioned above, a stripper may be provided at any one or at all of the work stations, but in FIG. 9*a* only one stripper is illustrated.

In a machine incorporating the present invention, an entire tool pack can be easily removed from the machine by merely removing the two bolts 60, disconnecting the shear and transfer system, and removing the spring beams 121. Reinstallation of the tool pack or another tool pack containing different tooling is easily accomplished by positioning the tool pack on the basic machine frame and inserting the bolts 60. Then, after the shear and transfer are reconnected and the beams 121 are installed, it is only necessary to provide minor final adjustment before operation of the machine can be recommenced.

Most of the drive linkages are automatically placed in an operative condition during the installation of the tool pack in the machine. For example, the linkage for operating the kickout of the tools needs no special connection and the linkage for operating the die kickouts and the stripper needs no individual connection operation. Consequently, a complete changeover of the machine from one set of tooling to another is easily accomplished.

Further, since the reciprocating tools are guided by individual bearings within the tool pack itself, extreme precision can be obtained even if the bearings for the bolster do not precisely position the bolster. Further, since the forging loads are not transmitted through the portion of the tool pack which guides the tool carriers, deflections created by such forging loads do not adversely affect the alignment of the tools and dies.

Although the preferred embodiment of this invention has been shown and described, it should be understood that various modifications and rearrangements of the parts may be resorted to without departing from the scope of the invention as disclosed and claimed herein.

What is claimed is:

1. A progressive former for progressively forging workpieces, comprising a frame, a bolster reciprocable on said frame, a tool pack providing a tool pack base assembly removably mounted as a unit on said frame, tooling mounted on said tool pack base assembly cooperating to define a plurality of work stations, each work station providing a die means mounted on said tool pack base assembly in a fixed position, bearing means on said tool pack base assembly, and a tool means reciprocably mounted in said tool pack base assembly and guided by said bearing means, said tool and die means at said work stations cooperating to progressively forge a workpiece to a finished desired shape, and a releasable connection connecting said tool means to said bolster causing said tool means to reciprocate relative to their associated dies in response to reciprocation of said bolster, said tool means being laterally positioned relative to said associated dies by said tool pack base assembly independent of said bolster, and a transfer operable to progressively position workpieces at said work stations.

2. A progressive former as set forth in claim 1, wherein said transfer is mounted on said tool pack base assembly for installation and removal therewith, and a powered drive on said frame is connected to reciprocate said bolster, said powered drive also including a transfer drive releasably connected to said transfer operating said transfer in timed relation to the reciprocation of said tool means.

3. A progressive former as set forth in claim 1, wherein said releasable connection includes a beam spring which engages said tool means intermediate its ends and is connected at its ends to said bolster.

4. A progressive former as set forth in claim 3, wherein one end of said beam spring is connected to said bolster by cam means which operate to stress said beam spring during installation.

5. A progressive former as set forth in claim 4, wherein said cam means is rotatable through less than one turn to release and connect said one end of said beam spring.

6. A progressive former as set forth in claim 1, wherein at least one of said tools and dies provides kickout means operable to eject said workpieces from said tooling, a powered drive on said frame connected to reciprocate said bolster and providing a kickout drive, and releasable kickout drive connection means connecting said kickout drive and said kickout means and operating said kickout means in timed relation to the reciprocation of said tools.

7. A progressive former as set forth in claim 6, wherein said kickout means includes separate kickouts for said tool means and said die means.

8. A tool pack for forging machines comprising a base assembly, a plurality of separate die means mounted on the base assembly, separate tool means associated with each die means supported on said base assembly for movement toward and away from said associated die means, said die means and associated tool means cooperating to provide a plurality of separate die stations at which workpieces are progressively formed, and transfer means carried by said base assembly operable to progresssively transfer workpieces to each of said die stations, said tool pack being installable and removable as a unit in a forging machine having power drives for said tool means and transfer means, said tool pack permitting set-up of said tool means, die means, and transfer remote from said forging machine to allow removal and replacement of said tool means, die means, and transfer as a unit and without set-up thereof during installation to reduce the time required for tooling changeovers.

9. A tool pack as set forth in claim 8, wherein said tool pack provides bearings guiding said tool means, said tool means being adapted to be connected to a reciprocating bolster on said forging machine, and connection means adapted to releasably connect said tool means and said bolster, said bearings guiding said tool means independent of said bolster whereby deflections within the machine created by forming loads do not adversely affect the alignment of said tool means.

10. A forging machine for use with a removable tool pack, said machine comprising a frame, a bolster reciprocable on said frame, a power drive operable to reciprocate said bolster and including a transfer drive, releasable first connection means adapted to releasably connect said bolster to reciprocable tools, and releasable second connecting means adapted to releasably connect said transfer drive to a removable transfer, said machine allowing installation thereon and removable therefrom of a unitary tool pack including tooling providing a plurality of work stations providing fixed die means and reciprocable tool means guided by said tool pack for reciprocation relative to the associated die means and said transfer being operable to progressively transfer workpieces to said work stations.

11. A forging machine as set forth in claim 10, wherein said drive includes a kickout drive operable to actuate a kickout at each work station.

12. A forging machine as set forth in claim 11, wherein said kickout drive includes separate adjusting means for separately adjusting the kickout at each work station, and a single cam actuating the entire kickout drive.

13. A forging machine as set forth in claim 12, wherein said drive means includes a second kickout drive for each work station adapted to operate a second kickout on said tool pack at each work station.

14. A forging machine comprising a frame, a bolster reciprocable on said frame along an axis, a kickout system operable to eject workpieces from tooling mounted on said frame, and a power drive connected to reciprocate said bolster and operate said kickout system; said kickout system including a cam rotated by said power drive, a rocker arm journaled on said frame and oscillated by said cam to a predetermined angle from an operative position to the retracted position in response to rotation of said cam through one revolution, said rocker arm providing a first planar surface, an adjustment lever pivoted on said frame and providing a portion engageable with said first planar surface, said pivot of said adjusting lever being adjustable in a direction toward and away from said pivot on said rocker arm and parallel to said first planar surface when said rocker arm is in said operative position, said adjusting lever oscillating in response to oscillations of said rocker arm through an angle determined by adjustment of said pivot of said adjusting lever, and a wedge mounted on said adjustment lever for movement relative thereto, said wedge providing a second planar surface perpendicular to said axis when said rocker arm is in said operative position, adjustment of said adjusting lever adjusting the stroke of said kickout system without changing the position of said second planar surface when said rocker arm is in said operative position, adjustment of said wedge changing the position of said second planar surface when said rocker arm is in said operative position without changing the stroke of said kickout.

15. A forging machine for use with a removable tool pack, said machine comprising a frame, a bolster reciprocable on said frame, and a power drive operable to reciprocate said bolster, a tool pack providing reciprocable tools thereon, and resilient means releasably connecting said bolster to said tools causing said tools to reciprocate with said bolster, said resilient means including a beam spring, one end of said beam spring engaging a surface on said bolster to position said one end of said beam spring, tensioning means mounted on said bolster releasably connecting the other end of said beam spring, said beam spring engaging a surface on said tooling intermediate its ends to apply a resilient force thereto urging said tooling into engagement with said bolster, said bolster providing a wedge laterally adjustable relative thereto for adjusting the position of said tooling with respect to said bolster, and said beam spring providing sufficient resiliency to accommodate adjustment of said wedge and in turn adjustment of said tooling with respect to said bolster.

16. A forging machine for use with a removable tool pack in which said tool pack provides a plurality of work stations at which workpieces are progressively forged and a transfer for sequentially transferring workpieces to said work stations, said machine comprising a frame, a bolster reciprocable on said frame, a power drive including a crank and pitman connected to reciprocate said bolster, said power drive including a first cross shaft journaled on said frame on the side of said tool pack adjacent to said crank, a second shaft extending in the direction of bolster reciprocation journaled on said frame and connected for rotation with said first cross shaft, and a third cross shaft extending laterally of said machine journaled on said frame on the side of said tool pack remote from said crank connected for rotation by said second shaft, a shear operator cam on said second shaft operable to drive a shear mounted on said tool pack, transfer cam means on said second shaft operable to power a transfer carried by said tool pack, and a kickout cam mounted on said third cross shaft operable to power kickouts carried by said tool pack, and linkages powered by each of said cams and cam means permitting installation and removal of said tool pack and the components mounted thereon as a unit.

17. A forging machine as set forth in claim 16, wherein said machine includes a cam on said third shaft and a linkage driven thereby operable to power a stripper carried by said tool pack.

18. A forging machine as set forth in claim 16, wherein said machine provides feed rolls powered by cam means on said third shaft for feeding stock to said tool pack.

* * * * *